US006877258B2

(12) United States Patent
Frey

(10) Patent No.: US 6,877,258 B2
(45) Date of Patent: Apr. 12, 2005

(54) FRONT RETRACTING PLOW

(75) Inventor: Oscar Frey, Listowel (CA)

(73) Assignee: Agway Manufacturing, Listowel (CA)

( * ) Notice: Subject to any disclaimer, the term of this patent is extended or adjusted under 35 U.S.C. 154(b) by 0 days.

(21) Appl. No.: 10/215,436

(22) Filed: Aug. 9, 2002

(65) Prior Publication Data

US 2004/0025380 A1 Feb. 12, 2004

(51) Int. Cl.[7] ..... E01H 5/06
(52) U.S. Cl. ..... 37/281; 37/274
(58) Field of Search ..... 37/266, 269, 270, 37/274, 279, 281, 283; 172/815

(56) References Cited

U.S. PATENT DOCUMENTS

| | | | | |
|---|---|---|---|---|
| 3,477,151 A | * | 11/1969 | Zanella | 37/281 |
| 4,356,645 A | | 11/1982 | Hine et al. | |
| 4,369,847 A | * | 1/1983 | Mizunuma | 172/815 |
| 4,479,312 A | * | 10/1984 | Turgeon | 37/219 |
| 4,667,426 A | * | 5/1987 | Howard et al. | 37/232 |
| 4,723,609 A | | 2/1988 | Curtis | |
| 5,228,734 A | | 7/1993 | Pallastro | |
| 5,329,708 A | | 7/1994 | Segorski et al. | |
| 5,819,444 A | | 10/1998 | Desmarais | |
| 5,848,654 A | * | 12/1998 | Belcher, Jr. | 172/815 |
| 5,899,007 A | * | 5/1999 | Niemela et al. | 37/281 |
| 6,112,438 A | | 9/2000 | Weagley | |

* cited by examiner

*Primary Examiner*—Meredith C. Petravick
(74) *Attorney, Agent, or Firm*—Pearne & Gordon LLP

(57) ABSTRACT

The plow includes a vehicle mount for mounting the plow to a host vehicle, and a main blade mounted to the vehicle mount The plow further includes a pair of wing blades pivotally mounted to the main blade for travel in an arcuate path relative to the main blade, and four bar parallel arm linkages and actuators connected between opposing ends of the main blade and each of the wing blades for supporting and swinging the at least one wing blade in said arcuate travel path throughout the full distance between a retracted position in front of the main blade such that at least a substantial portion of the at least one wing blade is disposed in overlapping relation with the main blade, and an extended position in substantial longitudinal alignment with the main blade whereby a plurality of plowing widths is provided. It should be noted that the blade is advantageously used for the plowing of snow, however the plowing of other materials is envisioned such as sand or gravel.

43 Claims, 5 Drawing Sheets

FRONT RETRACTING PLOW

FIELD OF THE INVENTION

The present invention relates generally to plowing equipment, and more particularly to a retracting plow blade.

BACKGROUND OF THE INVENTION

In northern climates, snowplows wider than the standard plows used on highways and surface streets are required for the plowing of large areas such as parking lots and airport runways. As such, it is desirable to be able to plow as wide a swath as possible in one pass to minimize the time it takes to complete the plowing of an area. This can especially be the case for airport runways, where for safety reasons snow removal crews must adhere to guidelines on permissible snow accumulations, and time spent by an airliner sitting on a taxiway awaiting the removal of snow from a runway is highly expensive.

A traditional method of plowing a wide swath has simply been to maximize the width of a host vehicle mounted fixed blade. The problem is that maximizing blade widths is in direct conflict with a need to minimize that same blade for safe transport between worksites. With most snowplows typically mounted to multipurpose vehicles such as front-end loaders, wide blades cannot safely be driven from one site to another. In order to use such a wide fixed-blade plow at more than one site, it must be transported from one location to another separate from its host vehicle, such as on a flatbed truck.

Prior art blades have over the years provided a snowplow with a wide plowing profile that is adjustable from an open configuration for plowing, to a closed configuration for inter-site transport while still mounted to its host vehicle. To achieve this, various blade configurations have been devised to change the configuration of the blade from a minimized to a maximized width and back again. One variation involves telescoping wings that extend longitudinally beyond a main blade. These however involve complex components, and are prone to clogging and icing up.

Another variation involves the retracting of wing blades to the rear of a main blade for stowage during transport. The problem with this rearward-retracting configuration is that the wing blades must be tucked behind the main blade and are therefore in front of and adjacent to the tires of the host vehicle, making the retracted position of the wing blades proximal to the tires, thus creating a safety hazard. What is needed is a snowplow that provides a wide plowing profile as well as providing a compact transport profile and that also maintains the adjustable blades at a safe distance from the tires at all times. In addition, it would be advantageous to provide such a retracting blade in a more rigid design, to overcome the problems of prior art variable-width blades and their inherent lack of strength and stability. It should be noted that such a blade could readily be used for plowing materials other than snow, such as sand or gravel.

For the foregoing reasons, there is a need for an improved plow.

SUMMARY OF THE INVENTION

The present invention is directed to a front-retracting plow. The plow includes a vehicle mount for mounting the plow to a host vehicle, and a main blade mounted to the vehicle mount. The plow further includes at least one wing blade pivotally mounted to the main blade for travel in an arcuate path relative to the main blade, and at least one pivoting connector for supporting and swinging the at least one wing blade in said arcuate travel path throughout the full distance between a retracted position in front of the main blade such that at least a substantial portion of the at least one wing blade is disposed in overlapping relation with the main blade, and an extended position in substantial longitudinal alignment with the main blade, whereby a plurality of plowing widths is provided.

In an aspect of the present invention, the plow includes a pair of wing blades pivotally mounted to the main blade for movement into the extended positions at opposing ends of the main blade in substantial alignment therewith. In an aspect of the present invention, the wing blades are moveable independently between the extended and retracted positions. In an aspect of the present invention, when in the extended position, the main blade presents a plow face that is substantially aligned with a plow face defined by the at least one wing blade. In an aspect of the present invention, the at least one pivoting connector includes a four bar parallel arm linkage connected between the main blade and each wing blade.

In an aspect of the present invention, each pivoting connector includes a hydraulic actuator operatively connected for effecting movement between the retracted and extended positions. In an aspect of the present invention, each of the bars of the parallel arm linkages connect at points vertically spaced sufficient to resist torsional forces of the wing blades in relation to the main blade. In an aspect of the present invention, the vehicle mount enables the plow to be rotated in a horizontal plane to allow for inclination of the blades from the vehicles forward direction and a smaller transport profile.

By retracting one or more of the wing blades in front of the main blade, the plow is able to provide a reduced blade profile, while providing a transport width that enables transit between worksites over standard roads. At the same time the invention avoids the problems inherent in many prior art plows, where the retracting of wing blades behind the main blade introduces the risk of tire damage by having a sharp blade next to vulnerable tires.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PRESENTLY PREFERRED EMBODIMENT

Figure 1:
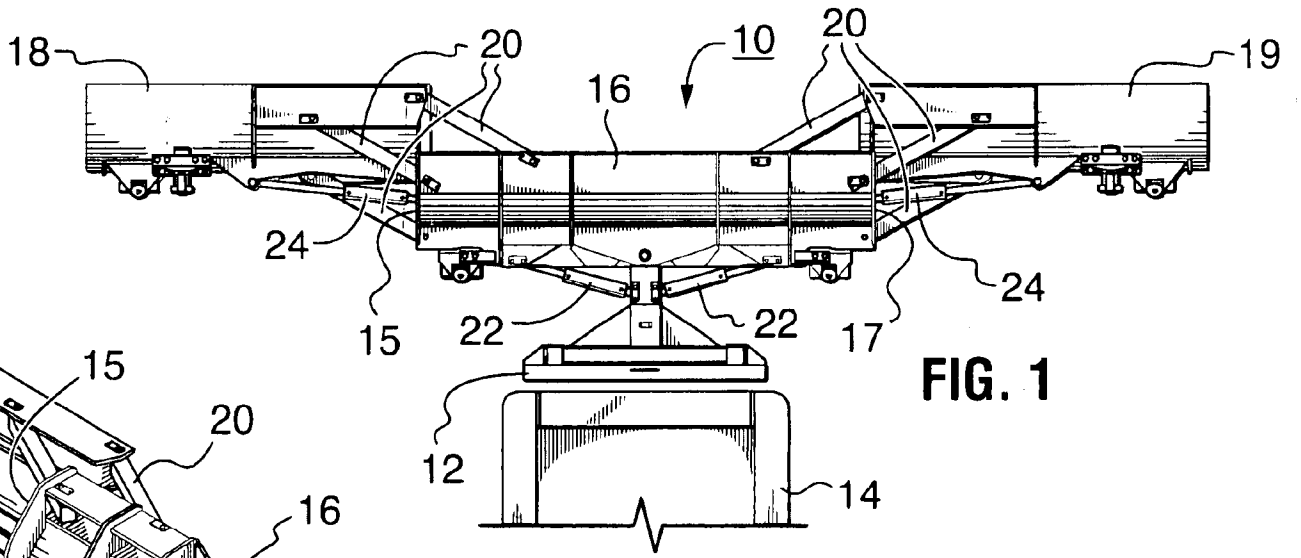
FIG. 1 is a top plan view of a front-retracting plow according to an embodiment of the present invention.
Figure 2:
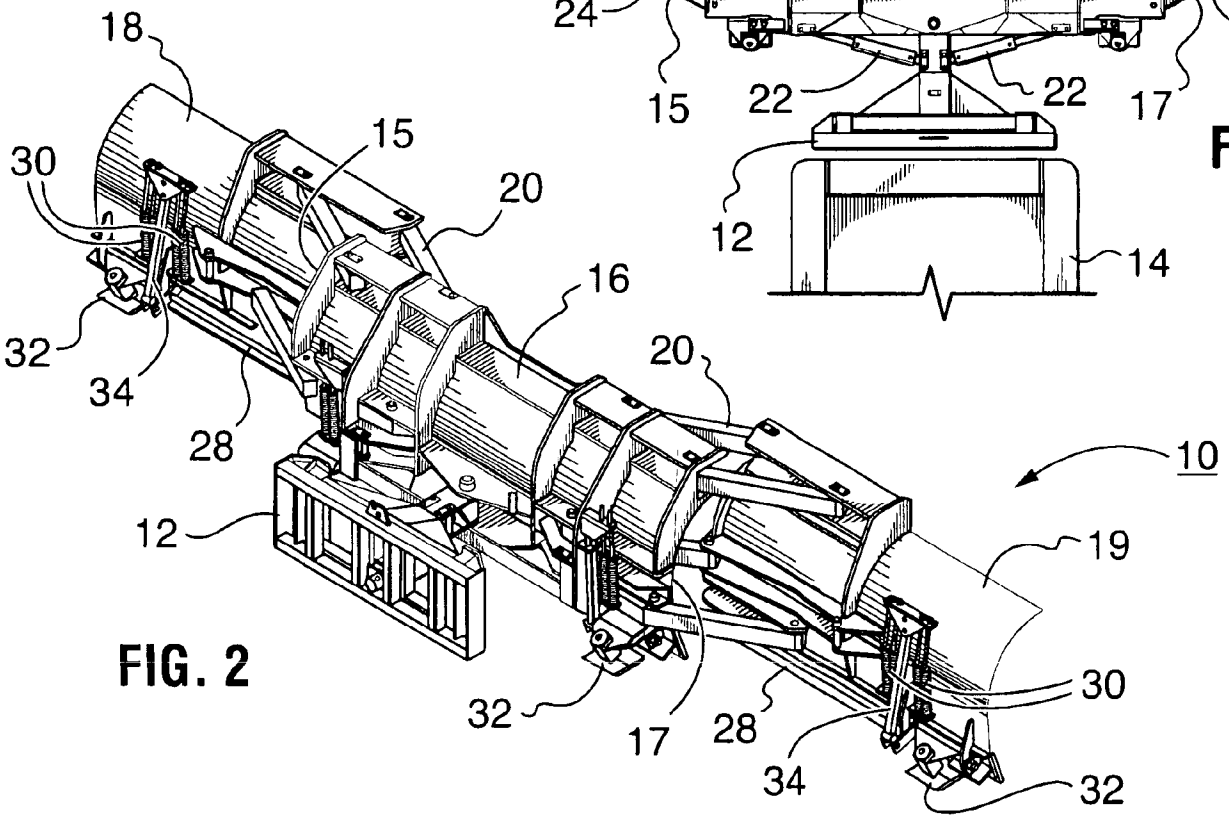
FIG. 2 is an isometric view of a front-retracting plow according to an embodiment of the present invention.
Figure 3:
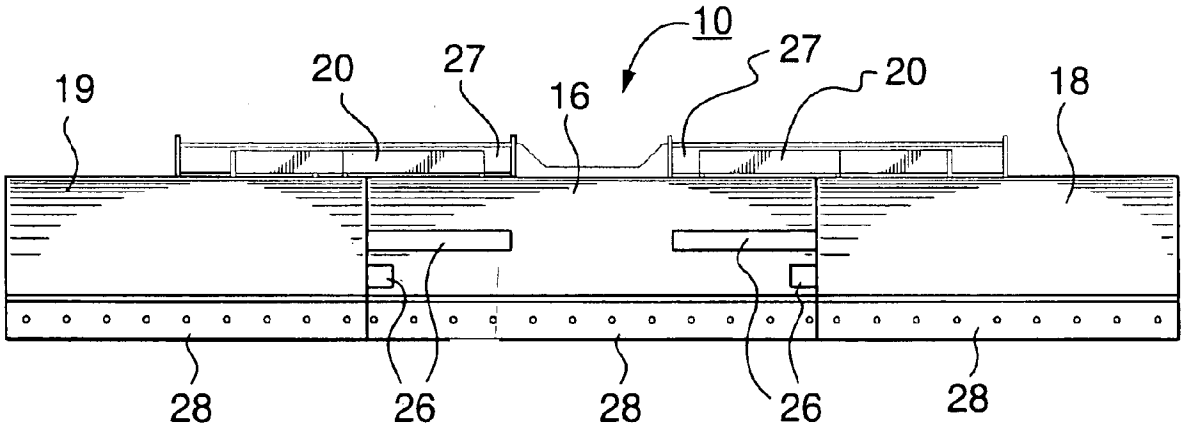
FIG. 3 is a front elevation view showing the wing blades in an extended position.
Figure 4:
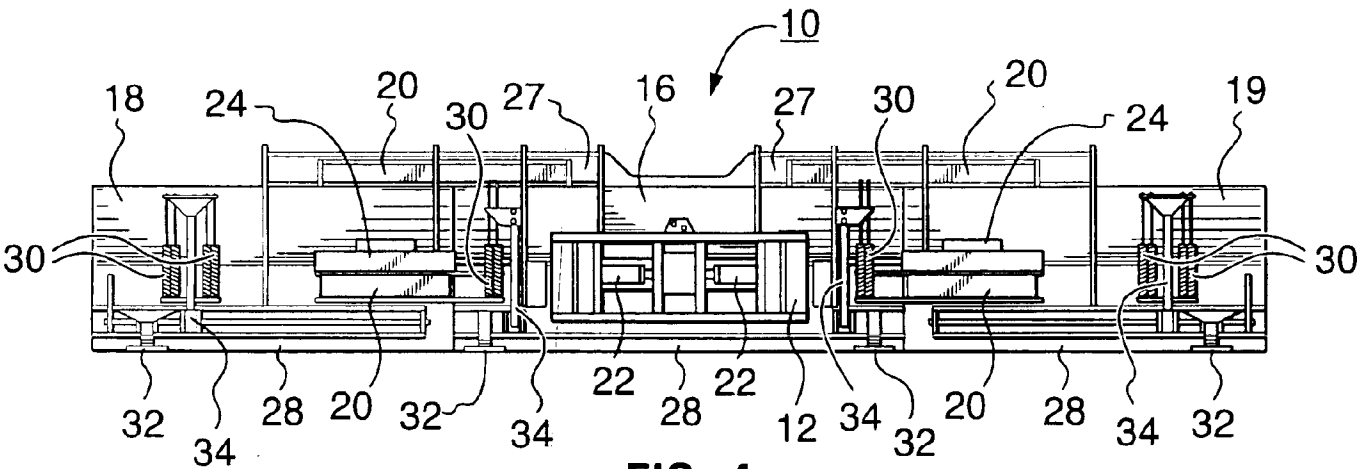
FIG. 4 is a rear elevation view showing the wing blades in an extended position.

The present invention is directed to a front-retracting plow 10. As illustrated in FIG. 1, the plow 10 includes a vehicle mount 12 for mounting the plow 10 to a host vehicle 14. A main blade 16 is mounted to the vehicle mount 12, and a left wing blade 18 and a right wing blade 19 are pivotally mounted to the left and right opposing ends 15 and 17 respectively of the main blade 16. The plow 10 further includes four bar parallel arm linkages 20 and hydraulic actuators 22 connected between opposing ends of the main blade 16 and each of the wing blades 18 and 19 for moving the wing blades 18 and 19 between retracted positions in front of and in close proximity to the main blade 16 and extended positions in longitudinal alignment with the main blade 16 and in end-to-end relation therewith, whereby a plurality of plowing widths is provided.

The main blade 16 is pivotally mounted to the vehicle mount 12 to allow inclination of the plow 10 through the horizontal plane, enabling plowing at various blade angles. To enable the pivoting of the plow 10, a pair of main blade-pivoting hydraulic actuators 22 are pivotally mounted between the vehicle mount 12 and the main blade 16, one on either side of the center of the vehicle mount 12 to transition the main blade 16 through the horizontal plane, as illustrated in FIG. 1. The main blade-pivoting hydraulic actuators 22 serve to incline the plow 10, either to the left or to the right, from a transverse position, and are operated in unison in opposite directions to horizontally pivot the main blade 16 to the desired blade angle.

The four bar parallel arm linkages 20, which support and move the wing blades 18 and 19 between the retracted positions and the extended positions, comprise pairs of upper and lower bars. The lower bars are, when transitioning between extended and retracted positions, allowed to freely extend through openings 26 formed in the main blade 16. The upper bars extend out from pockets 27 formed in upper framework of the main blade 16. One end of each bar of the four bar parallel arm linkage 20 is pivotally mounted to the main blade 16 with the other end of each bar mounted to its corresponding wing blade 18 or 19. The upper and lower bars of each linkage connect at points vertically spaced sufficient to provide the plow 10 with an inherent ability to resist unwanted torsional movement, which can lead to poor handling and/or plowing quality.

In order to maintain the wing blades 18 and 19 in a locked position when in either the fully extended or fully retracted position, stops are affixed to the plow 10 at appropriate positions. These stops provide a firm platform against which the hydraulic system can apply pressure. This enables the wing blades 18 and 19 to be lockable in both their extended and retracted positions. In addition, extending/retracting hydraulic actuators 24 are pivotally mounted between the main blade 16 and each wing blade 18 and 19. These actuators 24 provide the ability to transition the wing blades 18 and 19 between the extended and retracted positions.

Figure 5:
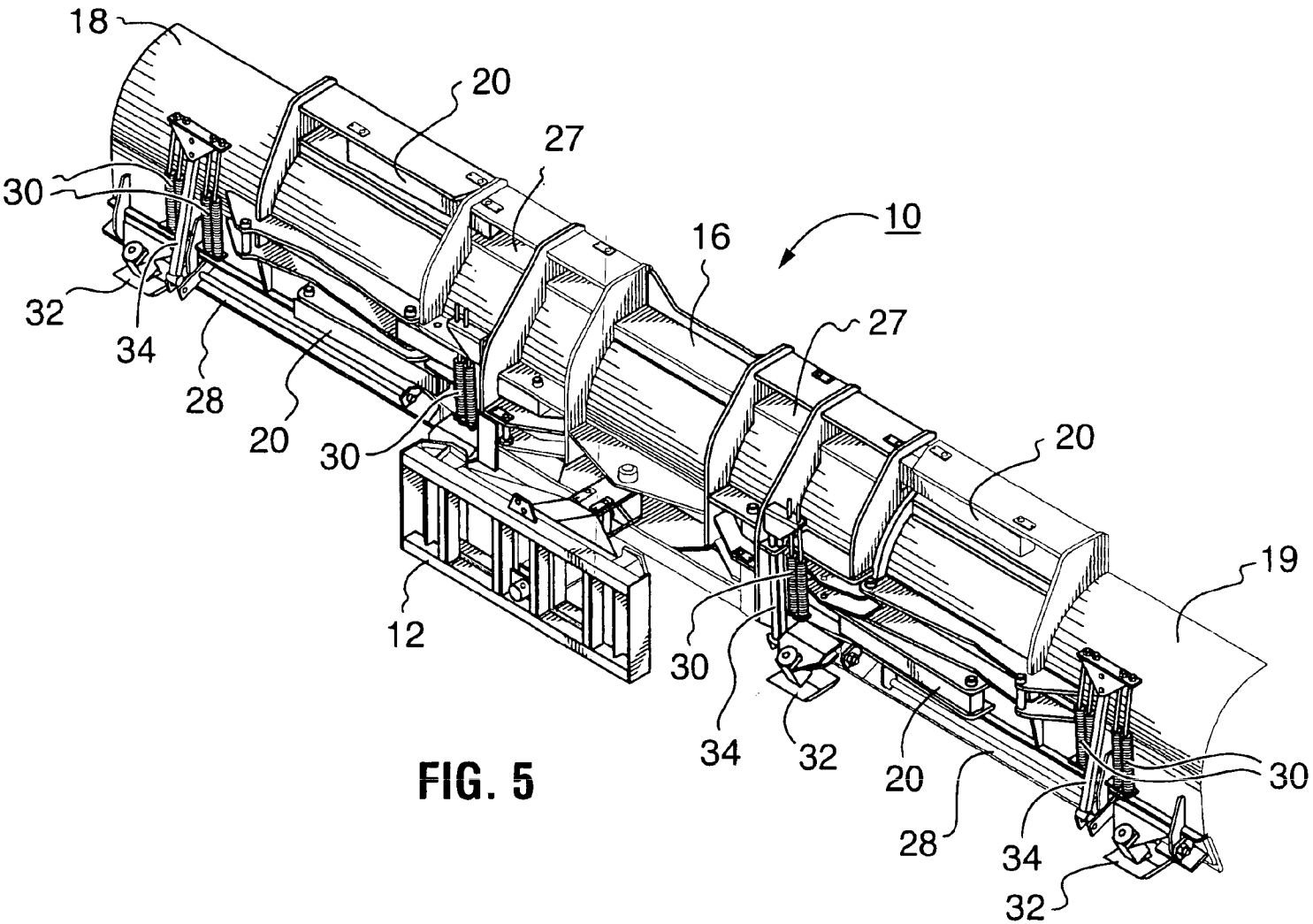
FIG. 5 is an isometric view showing the wing blades in an extended position.

As illustrated in FIG. 5, in an exemplary embodiment of the present invention, the bottom edges of all three blades 16,18 and 19 can include a striker lip 28 substantially coextensive with and hinged to each blade 16, 18 and 19 for pivotal movement rearward of the blade 16, 18 or 19. The striker lips 28 further include a resilient means for biasing the striker lips 28 to positions coplanar with their corresponding blades 16, 18 or 19. The striker lips 28 extend along, and are coextensive with their respective blades 16, 18 or 19, and are pivotally connected thereto so that, the striker lips 28 can pivot rearward when striking an obstacle when the host vehicle 14 is moving forward, but will remain upright when the plow 10 is moving rearward since the striker lips 28 do not pivot forward. Coil springs 30 are mounted to the blades 16,18 and 19 and serve to bias the striker lips 28 to a normal position coplanar with their respective blades 16, 18 or 19. The coil springs 30 are extended by a rocker arm 34 pivot mounted to a striker lip 28 at one end, and to the tops of a coil spring 30 at the other end, so that when an object is struck, the striker lip 28 is swept rearward, forcing the rocker arm to extend the coil spring.

Figure 6:
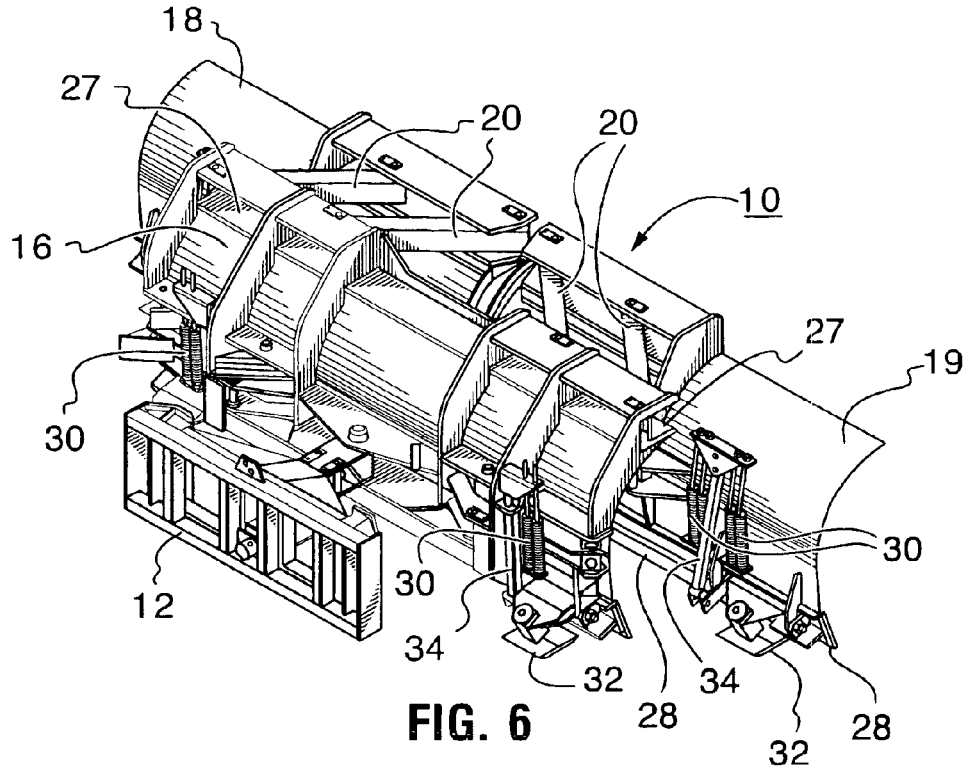
FIG. 6 is an isometric view showing the wing blades in a retracted position.

Further, the blades 16, 18 and 19 each include at least one removable wear shoe 32 for sliding contact with the ground surface, as illustrated in FIG. 6. The wear shoes 32 have surfaces for easy riding over surface irregularities. The wear shoes 32 are "sacrificial" members of the plow 10. They are bolt mounted for replacement when necessary. The wear shoes 32 provide a clearance between ground level and the edge of the blades 16, 18 and 19.

In accordance with the present invention, the hydraulic actuators 22 and 24 are preferably controlled from a central control panel provided in the cab of the host vehicle 14 for easy access by an operator. In general, the fluid supply, hydraulic piping or circuitry, and control panel used for actuating the hydraulic actuators 22 and 24 have not been illustrated in order to avoid undue complication in the drawings.

Figure 7:
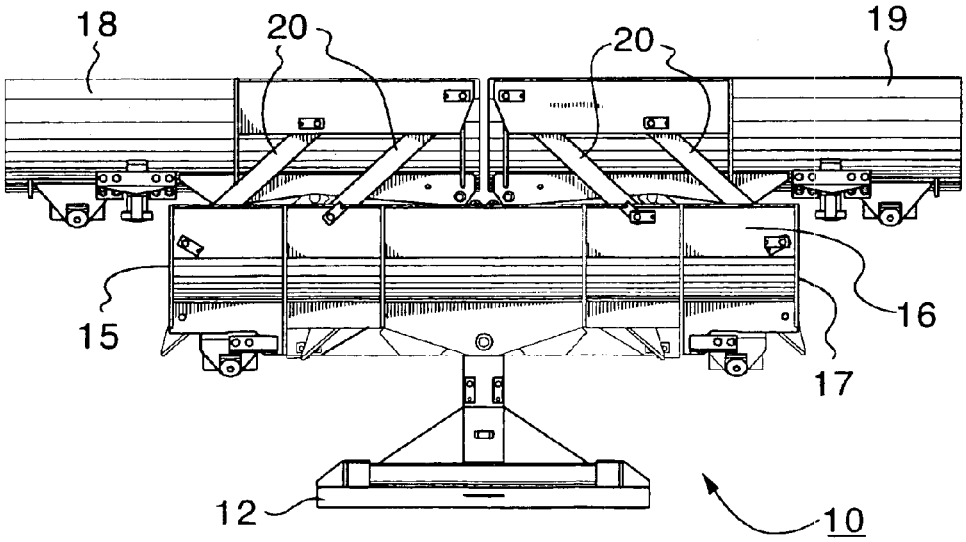
FIG. 7 is a top plan view showing the wing blades in a retracted position.
Figure 8:
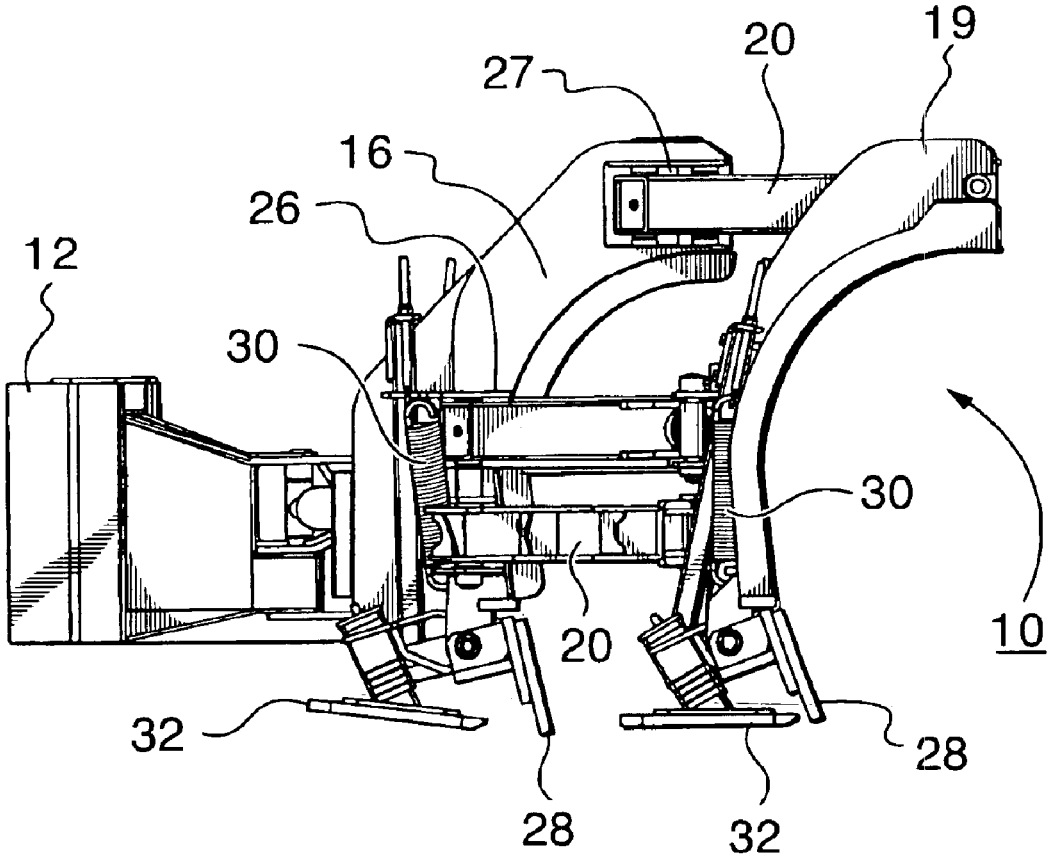
FIG. 8 is a side elevation view showing the wing blades in a retracted position.

As illustrated in FIG. 7, by retracting the wing blades 18 in front of the main blade 16, the plow is able to provide a reduced blade profile providing a transport width that enables transit between worksites over standard roads. At the same time the invention avoids the problems inherent in many prior art plows, where the retracting of wing blades behind the main blade introduces the risk of tire damage by having a sharp blade next to vulnerable tires.

It can further be appreciated that the invention is applicable to arrangements where only a single wing blade 18 or 19 is aligned with the main blade 16, correspondingly reducing the width of the plowing profile. The invention provides a novel front-retracting variable plow blade that avoids the problems and limitations of the prior art blades.

Although the present invention has been described in considerable detail with reference to certain preferred embodiments thereof, other versions are possible. Therefore, the spirit and scope of the appended claims should not be limited to the description of the preferred embodiments contained herein.

What is claimed is:

1. A front-retracting plow comprising:

a vehicle mount for mounting the plow to a host vehicle;

a main blade mounted to the vehicle mount;

at least one wing blade pivotally mounted to the main blade for travel in an arcuate path relative to the main blade; and a pivoting connector arm assembly for supporting and swinging the at least one wing blade in said arcuate travel path throughout the full distance between a retracted position in front of the main blade such that at least a substantial portion of the at least one wing blade is disposed in overlapping relation with the main blade, and an extended position in substantial longitudinal alignment with the main blade, whereby a plurality of plowing widths is provided.

2. The plow according to claim 1, including a pair of said wing blades pivotally mounted to the main blade for swinging movement into the extended positions at opposing ends of said main blade in said substantial alignment therewith.

3. The plow according to claim 2, wherein the wing blades are moveable independently between the extended and retracted positions.

4. The plow according to claim 1, wherein, when in the extended position, the main blade presents a plow face that is substantially aligned with a plow face defined by the at least one wing blade.

5. The plow according to claim 1, wherein said pivoting connector assembly includes a four bar parallel arm linkage connected between the main blade and each said wing blade.

6. The plow according to claim 1, wherein each said pivoting connector assembly includes a hydraulic actuator operatively connected for effecting movement between the retracted and extended positions.

7. The plow according to claim 5, wherein each of the bars of the parallel arm linkages connect at points vertically spaced sufficient to resist torsional forces of the wing blades in relation to the main blade.

8. The plow according to claim 1, wherein the vehicle mount enables the plow to be rotated in a horizontal plane to allow for inclination of the blades from the vehicles forward direction and a smaller transport profile.

9. The plow according to claim 2, wherein, when in the extended position, the main blade presents a plow face that is substantially aligned with a plow face defined by the at least one wing blade.

10. The plow according to claim 3, wherein, when in the extended position, the main blade presents a plow face that is substantially aligned with a plow face defined by the at least one wing blade.

11. The plow according to claim 2, wherein said pivoting connector assembly includes a four bar parallel arm linkage connected between the main blade and each said wing blade.

12. The plow according to claim 3, wherein said pivoting connector assembly includes a four bar parallel arm linkage connected between the main blade and each said wing blade.

13. The plow according to claim 4, wherein said pivoting connector assembly includes a four bar parallel arm linkage connected between the main blade and each said wing blade.

14. The plow according to claim 2, wherein each said pivoting connector assembly includes a hydraulic actuator operatively connected for effecting movement between the retracted and extended positions.

15. The plow according to claim 2, wherein the vehicle mount enables the plow to be rotated in a horizontal plane to allow for inclination of the blades from the vehicles forward direction and a smaller transport profile.

16. The plow according to claim 3, wherein the vehicle mount enables the plow to be rotated in a horizontal plane to allow for inclination of the blades from the vehicles forward direction and a smaller transport profile.

17. The plow according to claim 4, wherein the vehicle mount enables the plow to be rotated in a honzontal plane to allow for inclination of the blades from the vehicles forward direction and a smaller transport profile.

18. The plow according to claim 5, wherein the vehicle mount enables the plow to be rotated in a horizontal plane to allow for inclination of the blades from the vehicles forward direction and a smaller transport profile.

19. The plow according to claim 6, wherein the vehicle mount enables the plow to be rotated in a horizontal plane to allow for inclination of the blades from the vehicles forward direction and a smaller transport profile.

20. The plow according to claim 7, wherein the vehicle mount enables the plow to be rotated in a horizontal plane to allow for inclination of the blades from the vehicles forward direction and a smaller transport profile.

21. A front-retracting plow comprising:

a vehicle mount for mounting the plow to a host vehicle;

a main blade mounted to the vehicle mount;

at least one wing blade pivotally mounted to the main blade; and a pivoting connector arm assembly for swinging the at least one wing blade in an arcuate travel path between a retracted position in front of the main blade such that at least a substantial portion of the at least one wing blade is disposed in overlapping relation with the main blade, and an extended position in substantial longitudinal alignment with the main blade, the connector arm assembly being arranged such that the at least one wing blade remains substantially parallel to the main blade during the swinging in the arcuate travel path between the retracted position and the extended position; whereby a plurality of plowing widths is provided.

22. The plow according to claim 21, including a pair of said wing blades pivotally mounted to the main blade for swinging movement into the extended positions at opposing ends of said main blade in said substantial alignment therewith.

23. The plow according to claim 22, wherein the wing blades are moveable independently between the extended and retracted positions.

24. The plow according to claim 21, wherein, when in the extended position, the main blade presents a plow face that is substantially aligned with a plow face defined by the at least one wing blade.

25. The plow according to claim 21, wherein said pivoting connector assembly includes a four bar parallel arm linkage connected between the main blade and each said wing blade.

26. The plow according to claim 21, wherein each said pivoting connector assembly includes a hydraulic actuator operatively connected for effecting movement between the retracted and extended positions.

27. The plow according to claim 25, wherein each of the bars of the parallel arm linkages connect at points vertically spaced sufficient to resist torsional forces of the wing blades in relation to the main blade.

28. The plow according to claim 21, wherein the vehicle mount enables the plow to be rotated in a horizontal plane to allow for inclination of the blades from the vehicles forward direction and a smaller transport profile.

29. The plow according to claim 22, wherein, when in the extended position, the main blade presents a plow face that is substantially aligned with a plow face defined by the at least one wing blade.

30. The plow according to claim 23, wherein, when in the extended position, the main blade presents a plow face that is substantially aligned with a plow face defined by the at least one wing blade.

31. The plow according to claim 22, wherein said pivoting connector assembly includes a four bar parallel arm linkage connected between the main blade and each said wing blade.

32. The plow according to claim 23, wherein said pivoting connector assembly includes a four bar parallel arm linkage connected between the main blade and each said wing blade.

33. The plow according to claim 24, wherein said pivoting connector assembly includes a four bar parallel arm linkage connected between the main blade and each said wing blade.

34. The plow according to claim 22, wherein each said pivoting connector assembly includes a hydraulic actuator operatively connected for effecting movement between the retracted and extended positions.

35. The plow according to claim 22, wherein the vehicle mount enables the plow to be rotated in a horizontal plane to allow for inclination of the blades from the vehicles forward direction and a smaller transport profile.

36. The plow according to claim 23, wherein the vehicle mount enables the plow to be rotated in a horizontal plane to allow for inclination of the blades from the vehicles forward direction and a smaller transport profile.

37. The plow according to claim 24, wherein the vehicle mount enables the plow to be rotated in a horizontal plane to allow for inclination of the blades from the vehicles forward direction and a smaller transport profile.

38. The plow according to claim 25, wherein the vehicle mount enables the plow to be rotated in a horizontal plane to allow for inclination of the blades from the vehicles forward direction and a smaller transport profile.

39. The plow according to claim 26, wherein the vehicle mount enables the plow to be rotated in a horizontal plane to allow for inclination of the blades from the vehicles forward direction and a smaller transport profile.

40. The plow according to claim 27, wherein the vehide mount enables the plow to be rotated in a horizontal plane to allow for inclination of the blades from the vehicles forward direction and a smaller transport profile.

41. A front-retracting plow comprising:

a vehicle mount for mounting the plow to a host vehicle;

a main blade mounted to the vehicle mount;

at least one wing blade pivotally mounted to the main blade; and a pivoting connector assembly including a four bar parallel arm linkage comprising a plurality of arms connected between the main blade and each said wing blade, for swinging the at least one wing blade between a retracted position in front of the main blade such that at least a substantial portion of the at least one wing blade is disposed in overlapping relation with the main blade, and an extended position in substantial longitudinal alignment with the main blade.

42. The plow according to claim 41, wherein each of the bars of the parallel arm linkages connect at points vertically spaced sufficient to resist torsional forces of the wing blades in relation to the main blade.

43. The plow according to claim 42, wherein the vehicle mount enables the plow to be rotated in a horizontal plane to allow for inclination of the blades from the vehicles forward direction and a smaller transport profile.

* * * * *